United States Patent [19]

Heng et al.

[11] Patent Number: 4,840,579

[45] Date of Patent: Jun. 20, 1989

[54] SLOTTED CONNECTION ARRANGEMENT FOR AN ELECTRIC WIRE, AND A CORRESPONDING CONNECTION TOOL

[75] Inventors: Jean-Paul Heng, Lyon; Ariel Ruiz, Villeurbanne; Alain Boissonnet, Ampuis, all of France

[73] Assignee: CGEE Althom, France

[21] Appl. No.: 214,713

[22] PCT Filed: Oct. 8, 1987

[86] PCT No.: PCT/FR87/00387

§ 371 Date: Jun. 1, 1988

§ 102(e) Date: Jun. 1, 1988

[87] PCT Pub. No.: WO88/02935

PCT Pub. Date: Apr. 21, 1988

[30] Foreign Application Priority Data

Oct. 10, 1986 [FR] France ..... 86 14133

[51] Int. Cl.[4] ..... H01R 4/24

[52] U.S. Cl. ..... 439/395; 29/857; 29/867; 29/748

[58] Field of Search ..... 439/389–419, 439/476; 29/854, 857, 861, 867, 748, 750, 754

[56] References Cited

U.S. PATENT DOCUMENTS

| | | | |
|---|---|---|---|
| 3,504,416 | 4/1970 | Schick | 29/203 |
| 3,628,202 | 12/1971 | Brown | 29/748 |
| 3,805,214 | 4/1974 | Demler, Sr. et al. | 339/17 |
| 3,810,288 | 5/1974 | Caveney et al. | 29/203 P |
| 4,210,378 | 7/1980 | Baribeau | 339/97 R |
| 4,466,682 | 8/1984 | Jusseau et al. | 339/97 R |
| 4,527,328 | 7/1985 | Moody et al. | 29/750 |
| 4,567,639 | 2/1986 | Fasano | 29/861 |
| 4,716,651 | 1/1988 | Kloiber et al. | 29/861 |

FOREIGN PATENT DOCUMENTS

| | | |
|---|---|---|
| 0045154 | 2/1982 | European Pat. Off. . |
| 2516711 | 5/1983 | France . |

*Primary Examiner*—David Pirlot

*Attorney, Agent, or Firm*—Sughrue, Mion, Zinn, Macpeak & Seas

[57] ABSTRACT

A connection arrangement which includes a conducting slotted connection part (3) fixed in a recess in an insulating housing (5) is provided with fixing means (52, 53) enabling a connection tool (6) to be positioned and fixed relative to the housing during a connection operation. The connection tool (6) includes bearing means (72, 73) enabling it to be positioned on the housing and a rigid wire inserting blade (60) which penetrates into the housing along the slot via a tool insertion orifice (51). A rigid insertion blade (60) co-operates with two flexible blades (62) in order to fix the tool in the insertion orifice (51).

7 Claims, 4 Drawing Sheets

SLOTTED CONNECTION ARRANGEMENT FOR AN ELECTRIC WIRE, AND A CORRESPONDING CONNECTION TOOL

The present invention relates to a slotted connection arrangement for piercing the insulation of and retaining one or more electric wires, and also to a tool for connecting wires in such an arrangement.

Such connection arrangements are usually implemented for interconnecting wires in junction-block type members or for connecting wires to electrical apparatuses.

Conventionally, each connection arrangement comprises a wire-stripping and retaining slot provided in a thin conducting part, with the slot being provided at one of its ends with a flared opening for facilitating longitudinal insertion into the slot of a wire to be connected which is disposed transversely relative thereto and thereby simultaneously cutting through the insulation around the wire. The core of the wire which is locally stripped by the opening to the slot comes into contact with the edges of said slot which clamp onto the core, thereby simultaneously providing electrical continuity between the wire and the conductive part and retaining the wire, while the insulating sheath of the wire is clamped between the edges of a sheath-clamping opening which face the slot for stripping and retaining the wire and which are provided in an insulating housing in which the conductive part is generally received.

In order to connect a wire to such an arrangement, it is necessary to apply an insertion force on the wire and this generally requires a force-multiplying tool, which is normally required to be simple, for example a lever.

This type of tool which serves to develop an adequate force suffers from the drawback of being inaccurate and sometimes dangerous for the connection arrangement when it is used by users whose strength, skill, or attention vary considerably.

Because of this, it is desirable to design connection arrangements and tools which ensure that connections of uniform quality are obtained at reasonable expense.

To this end, the present invention provides, firstly, a slotted connection arrangement for an electric wire, wherein at least one connection part is held in an insulating housing provided with at least one opening extending over a slot for stripping and retaining the core of the wire and for providing electrical connection and which is located along a wall of said connection part, said opening enabling a wire to be connected to be inserted transversely over a wire-stripping opening to the slot and also enabling the insulating sheath of the wire to be subsequently held fast. According to a characteristic of the invention the housing, which is provided with at least one insertion orifice for a rigid moving insertion blade belonging to an external tool, said tool being intended to slide along the slot while a wire is being inserted, is also provided with a device for positioning the tool via the insertion orifice, which device is constituted by a projection having the corresponding insertion orifice provided in the middle thereof and suitable for being received by translation blade, the inside of the insertion orifice being provided with latching rims for moving fixing elements carried by the end of the tool and suitable for penetrating into the insertion orifice prior to the insertion blade in order to latch onto the rims and thereby fix the tool relative to the insulating housing while said insertion blade is being actuated.

The invention also provides a connection tool having a rigid wire-insertion blade which is displaceable along a guide duct between a position in which said blade is retracted inside the duct in the tool and a position in which one of its ends projects beyond the tool, together with means for placing the tool on an insulating housing of a connection arrangement in an operating position over an insertion orifice of said housing for inserting the blade.

According to a characteristic of the invention, the connection tool comprises a wire-inserting blade exit end arranged to fit by translation over the outside of a projection of the housing with a blade insertion orifice located in the middle of the projection, the center of said end being provided with two flexible blades which are fixed inside the duct on either side of the insertion blade which blade therebetween, said two flexible blades projecting indentically beyond the duct outside the tool and each having an end in the form of a thickening in such a manner that said thickenings, when resiliently brought towards each other by the blades of which they form a part, occupy a position enabling them to be inserted in an orifice and are then splayed apart from each other by the insertion blade being extended from the tool, thereby latching said thickenings beneath the latching rims provided internally in the corresponding insertion orifice, and thereby holding the tool in its operating position on the housing until the insertion blade is retracted.

The invention, its characteristics and its advantages are described in the following description with reference to the figures listed below.

FIG. 1 shows a connection arrangement in accordance with the invention seen end-on.

The slotted connection arrangement in accordance with the invention is intended to be integrated in electrical equipment 1 of the type comprising a member or an apparatus for providing electrical connection of one or more wires 2 to said equipment.

Figure 2:
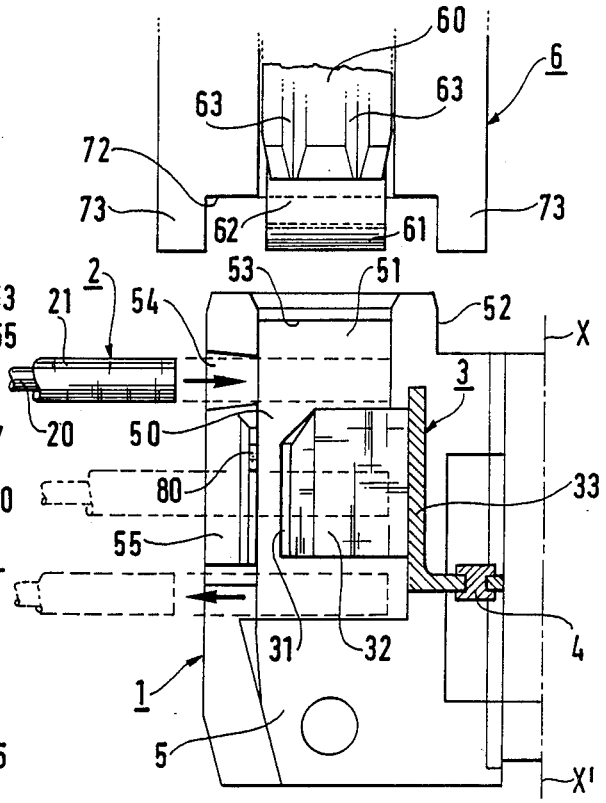
FIG. 2 is a section on line II—II of the FIG. 1 arrangement, together with a wire to be connected and a connection tool in accordance with the invention.

In the example shown here, the electrical equipment is a junction block and only one half of its is shown in FIG. 2, with the other half being symmetrical about a mid-plane on line XX' which is considered as being perpendicular to the plane of the drawing.

Each half of the junction block is provided with a slotted connection arrangement in accordance with the invention, with each connection arrangement including a conductive connection part 3 suitable for receiving at least one and possibly several wires in parallel.

In the embodiment shown, the conductive part 3 of a connection arrangement is suitable for being electrically connected to another conducting part of the block by means of a contact or member suitable for pressing against an appropriate stud 4 of the conducting part 3, with the other part and its contacting member not being shown herein.

Naturally, the conducting part 3 is also suitable for being directly connected via its base to a similar part mounted symmetrically relative thereto in a manner which is conventional in numerous junction blocks. The common strip interconnecting the bases of the parts would then not include any studs 4.

The part 3 is fixed in a recess 50 provided for this purpose in an insulating housing 5 which contains the electrical equipment 1 at least partially, and in this case which contains it fully. The insulating housing 5 is constituted, for example, by assembling two complementary half-shells, which may be fixed together, e.g. by ultrasonic welding after the internal members that they are to contain such as the conducting parts 3 and the contactor member have all been inserted therein.

Figure 1:
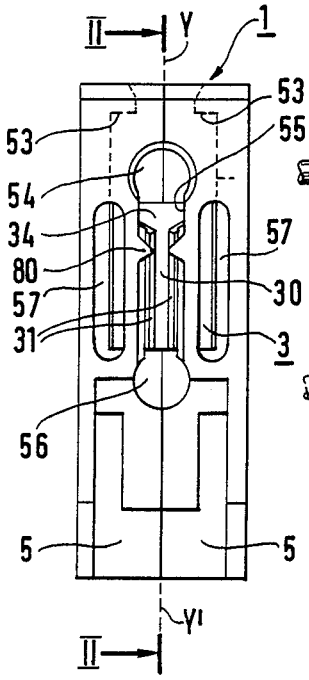

In the embodiment shown in FIG. 1, the two half-shells have a join plane which corresponds to a longitudinal mid-plane on line Y-Y'.

Each conducting part 3 has a slot 30 for stripping and retaining the cores 20 of wires 2 to be connected (see FIG. 1) said slot being rectilinear in this case and opening out to a wire-stripping opening 34 at one of its ends.

In the nonlimiting embodiment shown, the slot 30 is provided along a wall of a shaped portion of the part 3, which part is obtained by being stamped and simultaneously cut from a flat blank, and then folded and optionally thinned locally.

Figure 4:
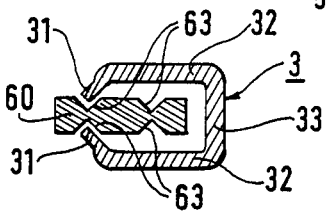
FIG. 4 is an assembly in section showing the blade of a connection tool in accordance with the invention positioned inside a conducting connection part of an arrangement in accordance with the invention.

The shaped portion of the part 3 has, for example, a hollow polygonal cross-section which in this case is substantially a U-shape with the free ends of the U being equally and slopingly folded towards each other as can be seen in FIG. 4.

The shaped portion obtained in this way has two ends lips 31 which correspond to the slopingly folded free ends mentioned above, with these two lips running along the edges of the slot 30 which they delimit, and in the present case their thickness is reduced on the outside on approaching the slot.

The two parallel walls 32, each of which carries one of the lips 31, participate in fixing the part 3 in its recess 50 together with the bottom wall 33 with respect to which they are disposed perpendicularly.

The wire stripping opening 34 of the conducting part 3 is obtained by a symmetrical sloping cut of the lips 31 at one of their ends, said sloping cut providing a flared opening. In a preferred embodiment of the walls 32 from which they extend gives rise to a top edge which is suitable for biting into the sheaths 21 of wires 2 thrust into said opening.

The lips 31, the parallel walls 32, and the bottom wall 33 delmit a cavity which opens out to the outside of the housing 5 via a "tool insertion" orifice 51 provided through the housing 5 in the vicinity of the wire stripping opening 34 and extending orthogonally thereto, and in the present case occupying the top of the block shown in FIG. 20.

In this case, the orifice 51 opens out into the central region of a device for positioning the tool and constituted by a projection 52 extending from the top portion of the housing 5 as shown in FIG. 2.

Figure 3:
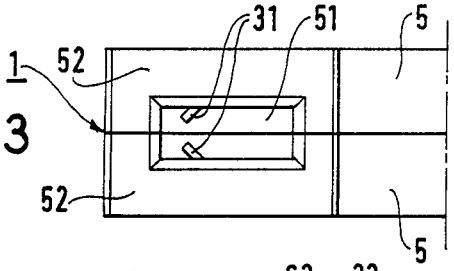
FIG. 3 is a plan view of the connection arrangement in accordance with the invention.

In this case, the projection 52 is rectangular in shape and has the orifice 51 passing through the middle thereof, which orifice is likewise rectangular in shape (see FIG. 3).

The orifice 51 is disposed in such a manner as to provide access into the housing 5 for the blade 60 of a connection tool 6 (see FIG. 2), and in this case it provides access to the slot 30 on either side of the lips 31, i.e. both inside and outside the shaped part.

At least two of the sides of the rectangular orifice 51, and in this case the longitudinal sides thereof, are provided with rims 53 which delimit the width of the orifice at the top of the projection 52 and which are intended to hook onto the connection tool 6. To this end, the tool is provided with swollen ends 61 mounted on flexible blades 62 which constitute moving fixing elements for fixing the tool to the housing.

The housing 5 is also provided with an opening which extends over the slot 30 to allow successive wires 2 to be inserted transversely above the wire stripping opening 34 and for clamping the sheaths 21 of these wires one above the other at the same time as the cores 20 thereof are clamped in the slot 30.

In this case, the opening has a cylindrical hole 54 through which a wire may be inserted axially above the wire-stripping opening 34 until it comes into abutment against the end of the recess 50, beyond the wire-stripping opening 34 of the conducting part 3.

The cylindrical hole 54 communicates with a rectilinear opening 55 which is open at its bottom end in FIG. 1 and which extends opposite the slot 30 when the conducting part 3 is in place.

The rectilinear opening 55 is intended to retain the sheaths 21 of connected wires 2, and its width is therefore slightly smaller than the smallest expected sheath diameter, and it includes projections 80 provided beneath the cylindrical hole 54 in the rectilinear opening in order to prevent a wire as clamped by its sheath in the rectilinear opening from moving back up towards the cylindrical hole 54.

In the embodiment shown, a second hole 56 is provided through the housing 50 at the other end of the rectilinear opening 55 from the hole 54, and this hole opens out beneath the slot 30 in the conducting part 3 in order to allow a wire which has previously been connected by clamping its core 20 in the slot 30 to be removed.

In another embodiment (not shown here) the rectilinear opening 55 closes at the bottom of the connection part and does not have a second hole.

Two auxiliary openings 57 run along the sides of the rectilinear opening 55 in order to enable those portions of the housing 5 which clamp against the sheaths to deform without changing the outside the dimensions of the housing when the sheaths are fixed therein.

Figure 6:
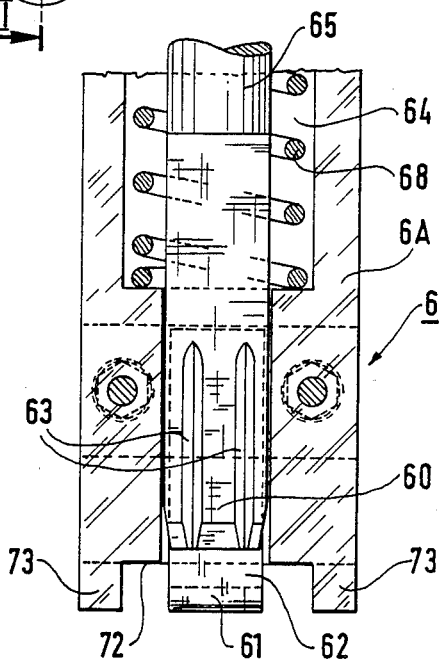
FIGS. 6 and 7 are two orthogonal central sections through a portion of a connection tool in accordance with the invention, with one of the half shells being removed FIG. 6.
Figure 8:
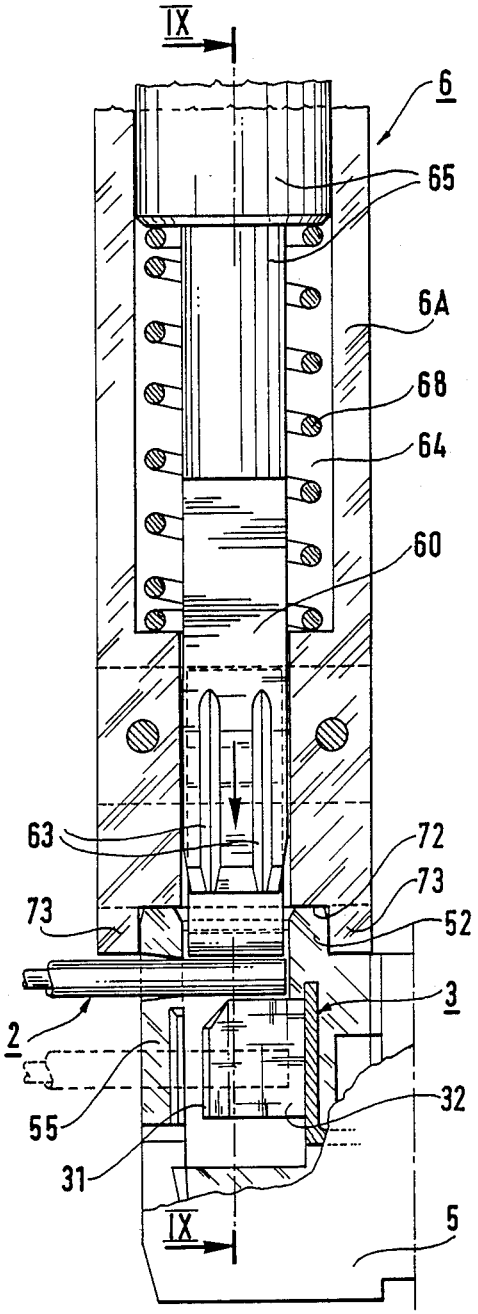
FIGS. 8 to 11 show four assemblies explaining tool operation successively prior to connection (for the first two figures) and after connection of a wire (for the last two figures), with one of the half shells being removed for FIGS. 8 and 10.

A connection tool 6 comprises, as mentioned above, a rigid tool-insertion blade 60 as shown in outline in FIGS. 2 and 4, and as shown in greater detail in FIGS. 6 and 8. This insertion blade 60 is intended to be inserted through the tool insertion orifice 51 into the recess 50 which contains the conducting part 3 and to move along the slot 30 of the conducting part.

The insertion blade 60 is intended to press against each wire 2 to be connected in such a manner as to thrust the core 20 of the wire transversely into the slot 30 and to thrust its sheath 21 into the rectilinear opening 55 with clamping taking place in both cases.

In a preferred embodiment, the insertion blade 60 is suitable for passing between the lips 31 of the slot 30 on either side of these lips, and it is therefore in the form of an elongate flat blade having symmetrically disposed longitudinal grooves 36 reducing its thickness to a value which is less than the distance betwen the lips 31 of the slot 30 of the connection part, thereby enabling it to slide longitudinally between said lips 31 each of which is then received in a corresponding groove.

In the embodiment shown, the insertion blade 60 includes two pais of grooves 63 which are disposed symmetrically relative to the longitudinal axis of the blade, which axis is assumed to be perpendicular to the plane of the drawing in FIG. 4. Such a disposition is advantageous, in particular, for the user in that there is no need to change the orientation of the connection tool for connecting wires to the conducting parts mounted back-to-back in a single housing, as is the usual case in junction blocks, in particular the junction block of which only one half is shown in FIG. 2.

A simplified solution (not shown) uses a blade which has only one pair of grooves 63. This blade corresponds, in practice, to half of the blade 60 as shown in FIG. 4 after being cut longitudinally along a mid-transverse plane, and the blade could be symmetrical about a transverse plane passing through the botttoms of the grooves 63, for example.

Figure 5:
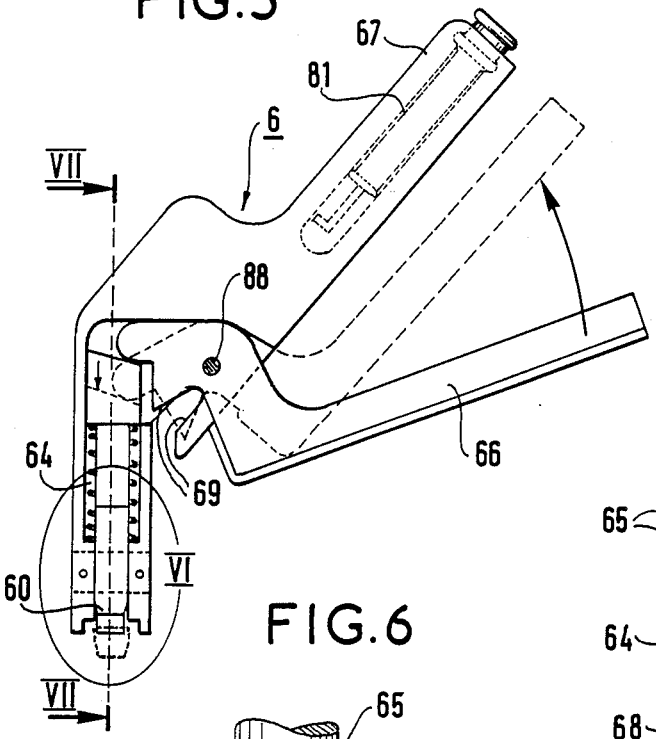
FIG. 5 is a diagrammatical section through an example of a manual connection tool in accordance with the invention with its half-shell being removed therefrom.

The insertion blade 60 of the connection tool 6 shown in FIG. 5 slides along a guide duct 64 which also contains a pusher 65, which pusher may be cylindrical in shape, and which carries the insertion blade 60 at one end thereof while receiving thrust at its opposite end from an operating lever 66 hinged to a grasping handle 67 of the tool.

Figure 7:
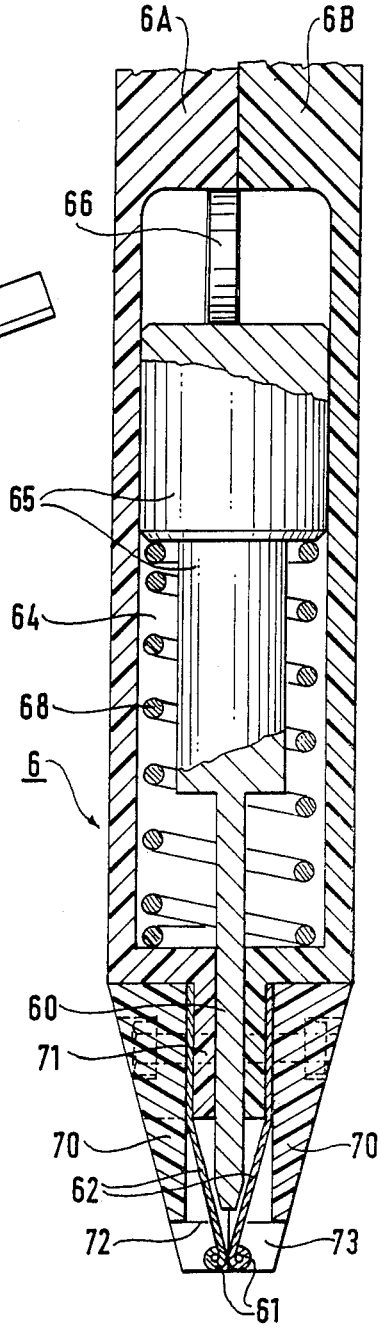

The portion of the connection tool in which the guide duct is formed is constituted, for example, by two symmetrical half-shells 6A and 6B which are fixed together (see FIG. 7).

A coil spring 68 surrounds a portion of the pusher 65 and/or the insertion blade 60 in this example and tends to urge the insertion blade towards the top of the duct 64 into a retracted position when the lever 66 is released after a complete stroke, with a conventional ratchet system (not shown) requiring the user to go to the end of any stroke once it has begun.

When the lever 66 is pulled towards the handle 67, the insertion blade 60 moves out from the duct 64 and out from the tool 6. Additionally, the lever and the handle have respective cutting portions 69 like a pair of snips located close to their common hinge 80 for the purpose of cutting a wire prior to performing a connection operation per se.

Two fixing parts 70 are disposed on either side of the insertion blade 60, and two flexible blades 62 are disposed on either side of the insertion blade serving to fix the flexible blades to the body of the tool 6 beyond the duct 64 on either side of a guide 71 in which the insertion blade 60 slides.

The insertion blade 60 is set back relative to the flexible blades when the lever 66 is released, and it slides between them pushing them apart when the lever is pressed.

In the example shown, the flexible blades 62 have their bases terminating parallel to the insertion blade 60 and they slop towards each other beyond the guide 71 and outside the tool 6 so as to meet at their free ends. The two touching free ends are rolled outwardly in order to form respecting thickenings 61 which facilitate insertion and extraction of the tool into and outfrom the orifice 51 by virtue of their rounded shapes.

The thickenings 61 splay outwardly when the insertion blade 60 projects from the tool 6 and they return towards each other when the lever is released and as a result the insertion blade 69 is retracted into the tool 6.

In order to obtain good connection uniformity, the connection tool 6 positions itself accurately relative to the orifice 51 of a connection arrangement in a housing 5 by having its blade exit end latching in translation against the projection 52 through the middle of which the insertion orifice 51 concerned passes.

To this end, the half-shells 6A and 6B unite to constitute a two-part tubular endpiece with the parts meeting and providing a bearing surface enabling the tool 6 to be positioned on the projecting element 52 of a plane trust zone 72 (FIGS. 6 to 8) and to center itself relative to said projecting element which it encloses laterally by virtue of two lateral centering elements constituted in this case by projections 73, as shown in FIG. 8.

The plane bearing zone 72 formed at the end of the half-shells 6A and 6B include two fixing parts 70 at corresponding ends thereof.

In the embodiment shown, the extensions 73 terminate at the same level as the thickenings 61 to which they provide partial protection, with the flexible blades 62 projecting from the middle of the blade outlet end.

The width of the orifice 51 in a connection arrangement in a housing 5 corresponds in practice to the sum of the thicknesses of the flexible blades 62 and of the insertion blade 60 so that adequate transverse positioning of the tool 6 is obtained when the thickenings 61 are beneath the rims 53, with the flexible blades 62 and the insertion blade 60 then all passing together through the orifice.

In order to connect a wire 2 to a conducting part 3 of a connection arrangement received in a housing 5, a non-stripped end of the wire 2 is inserted into the hole 54 until it comes into abutment with the rear of the recess 50 above and beyond the lips 31 of the slot 30 in the conducting part 3 (see FIG. 8).

Figure 9:
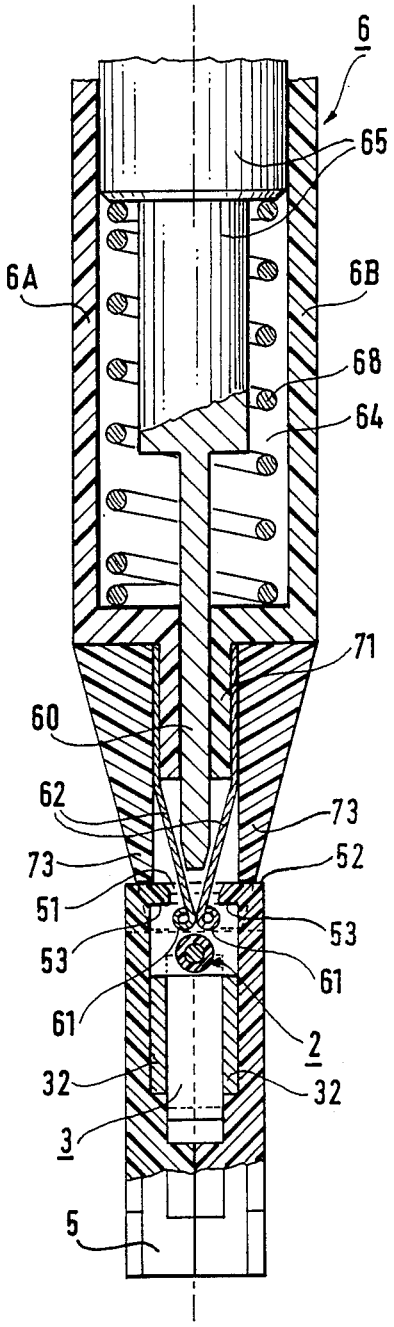

The tool 6 is positioned with its lever released and therefore with the insertion blade 60 retracted over the projection 52 onto which it fits with the tubular endpiece being received in translation on to said projection. To this end, the lateral centering elements 73 come into place on either side of the projection (see FIG. 8) and the thickenings 61 of the flexible blades 62 enter through the orifice 51 to occupy positions beneath the rims 53, while the plane bearing surface 72 of the connection tool 6 presses against the top of the projections 52 (see FIG. 9).

When pressure is exerted on the lever 66 of the connection tool 6 so as to move it towards the handle 67, the pusher 65 is driven in translation as is the insertion blade 60, and simultaneously the spring 68 is compressed. The insertion blade 60 then pushes the flexible blade 62 apart so that their thickenings 61 are lodged beneath the rims 53 of the housing, thereby fixing the tool 6 to the housing 5.

Figure 10:
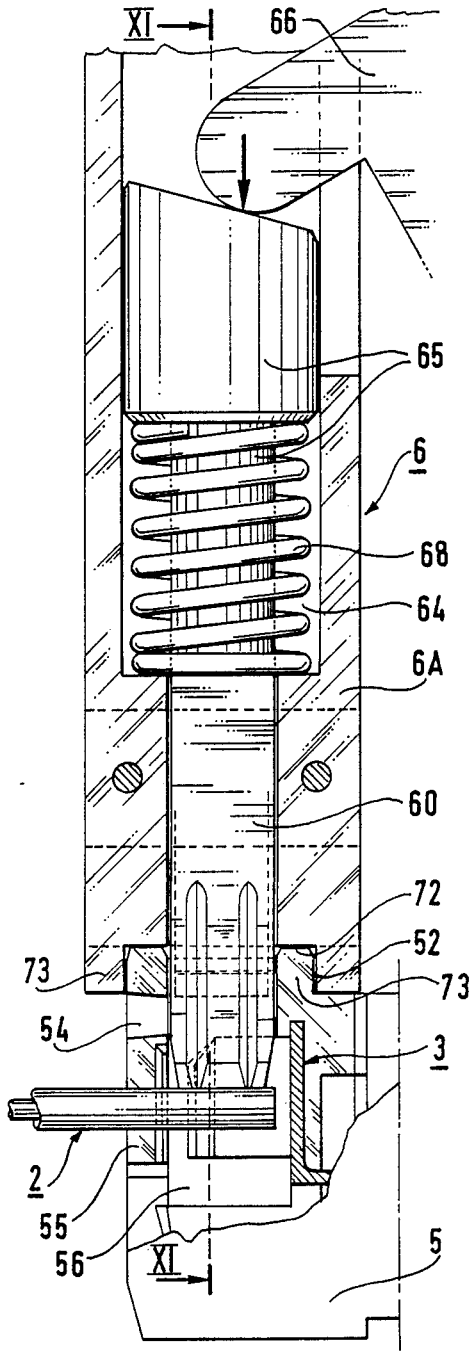
Figure 11:
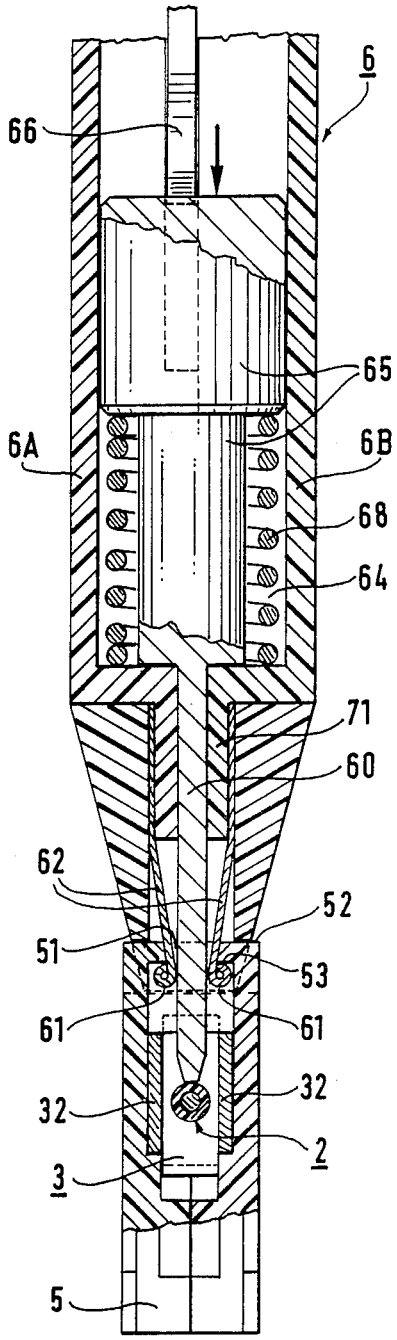

The insertion blade 60 bears against the sheath 20 of the wire to be connected and begins by urging it into the wire stripping openings of the connection part where the sheath is cut, thereafter it urges the wire into the slot 60 and along the opening 55 so that the core 20 and the sheath 21 of the wire are respectively clamped therein (see FIGS. 10 and 11).

When the tool lever is released, the insertion blade 6 is retracted into the tool by the spring 68 and the thickenings 61 move towards each other resiliently, thereby releasing the tool 6 from the housing 5.

The second wire can thus be connected in identical manner with the second wire resiliently urging the first wire further down along the slot 30 and along the opening 55.

It is also possible to extract the first-connected wire 2 by means of the insertion blade 60 which presses said first wire outfrom the conductive part 3 via the hole 56 which enables it to be extracted.

The action of the lever 66 must be extended in order to obtain this result, and it is preferable to provide a system, e.g. a ratchet system, associated with the lever in a conventional manner which is not described herein in order to distinguish between the connection stroke of the lever and the longer disconnection stroke thereof.

When the rectilinear opening 55 is closed at the bottom of the connection part 3 without being any hole 56 at the bottom of the opening, an extraction tool 81 may be provided which enters via the orifice 51 in the absence of the tool 6 in order to extract a previously-connected wire 2.

The extraction tool 81 which is shown received in the handle 67 of the tool 6 in FIG. 5 is constituted in this case by a handle carrying a rigid rod which is bent at a right angle at its end.

The extraction tool 81, after being extracted from the handle 67, serves to lift a wire 2 which is held in the stripping and clamping slot of the connection part 3 by penetrating into the connection part via the orifice 51 and then hooking beneath the wire 2 by means of its bent end. The wire 2 is thus raised towards the cylindrical hole 54 through which it can subsequently be extracted.

The blade of the tool may naturally be actuated by means other than the lever system, for example it might be actuated through its pressure system which would not require a handle.

We claim:

1. In a slotted connection arrangement for an electric wire (2), in particular for use in an electric junction block, wherein at least one connection part (3) is held in an insulating housing (5) provided with at least one opening extending over a slot (30) for the stripping and retaining the core of the wire and for providing electrical connection and which is located along a wall of said connection part, said opening enabling a wire to be connected to be inserted transversely over a wire-stripping opening (34) to the slot and also enabling the insulating sheath (21) of the wire to be subsequently held fast, the improvement wherein the housing is provide with at least one insertion orifice (51) for a rigid moving insertion blade belonging to an external tool, said blade being extended to slide along the slot while a wire is being inserted and said housing being provided with a device for positioning the tool via the insertion orifice, said device comprising a projection (52) having said insertion orifice (51) provided in the middle thereof and suitable for being received by translation in the end of the tool which includes said insertion blade, the inside of the insertion orifice being provided with latching rims (53) for moving fixing elements (61, 62) carried by the end of the tool and suitable for penetrating into the insertion orifice prior to the insertion blade in order to latch onto the rims and thereby fix the tool relative to the insulating housing while the tool insertion blade is being actuated.

2. A slotted connection arrangement according to claim 1, characterized in said tool positioning device constituted by said projection (52) is rectangular in shape and is centered around said insertion orifice (51), and said insertion orifice is also rectangular, with two parallel sides comprising said latching rims (53) which are symmetrically disposed.

3. A connection tool for connecting at least one electric wire to the connection arrangement according to claim 2, the tool being provided with a rigid wire insertion blade (60) which is displaceable along a guide duct (64) between a position in which said blade is retracted inside the duct in the tool (6) and an insertion position in which one of its ends projects beyond the tool, together with means for positioning the tool on an insulating housing of a connection arrangement in an operating position over an insertion orifice of said housing for inserting the blade, the tool (6) being characterized in that it comprises a wire-inserting blade exit end (72, 73) arranged to fit by translation over the overside of a projection (52) of the housing with the blade insertion located in the middle of the projection, the center of said end being provided with two flexible blades (62) which are fixed inside the guide duct (64) on either side of the insertion blade which slide therebetween, sid two flexible blades projecting identically beyond the duct outside the tool and each having anend in the form of a thickening (61) in such a manner that said thickenings, when resiliently brought towards each other by the blades of which they form a part, occupy a position enabling them to be inserted in an orifice and are then splayed apart from each other by the insertion blade being extended from the tool, thereby latching said thickenings beneath the latching rims (53) provided internally in the corresponding insertion orifice (51), and thereby holding the tool in its operating position on the housing (5) until the insertion blade is retracted.

4. A connection tool for connecting at least one electric wire to a connection arrangement, said connection arrangement icluding an insulating housing, siad housing having a projection (52), a blade insertion orificer (51) located in the middle of the projection (52), and said insertion orifice (51) including latching rims (53), provided internally thereof, said tool comprising a guide duct, a rigid wire insertion blade (60) which is displaceable along said guide duct (64) for displacement between a position in which said insertion blade is retracted inside the duct in the tool (6) and an insertion position in which one of its ends projects beyond the duct, said tool further comprising means for positioning the tool on said insulating housing of said connection arrangement in an operating position over said insertion orifice (51) for insertion of the blade therein, the improvement wherein said tool guide duct comprises a wire-inserting blade exit end arranged to fit by translation over the outside of said projection (52) of the housing, said exit end having a center provided with two flexible blades (62) which are fixed inside the guide duct (64) on either side of the insertion blade which slides therebetween, said two flexible blades projecting identically beyond the duct exit end, outside the tool and each having an end in the form of a thickening (61), said thickenings, when resiliently brought towards each other by the flexible blades, occupy a position enabling them to be inserted in said orifice and are then splayed apart from each other by the insertion blade being extended from the tool, thereby latching said thickenings beneath the latching rims (53) provided internally in the corresponding insertion orifice (51), nad thereby holding the tool in its operating position on the housing (5) until the insertion blade is retracted.

5. A connection tool according to claim 3, wherein said housing has a connection part (3) provided with a wire stripping and retaining slot (30) terminating in opposed lips (31), and wherein said connection tool insertion blade is a plane blade provided with symmetrical longitudinal grooves (63) of reduced thickness which are less than a gap between said lips (31) of said wire stripping and retaining slot (30) in order to slide between said lips while pressing against a wire (2) to be connected on either side of the slot.

6. A connection tool according to claim 4, characterized in that the blade exit end of the tool is provided with positioning means in the form of a plane tool thrust zone (72) at the end of the positioning projection of said tool, and fixed lateral centering elements (73) ensuring that the tool is accurately positioned laterally on the projection relative to the insertion orifice (51) in order to enable accurate penetration of the insertion blade into said orifice during a connection operation.

7. A connection tool according to claim 6, characterized in that the positioning means form a tubular endpiece suitable for engaging by translation over a projection of the housing in order to accurately fix the tool relative to the insertion orifice through said projection.

* * * * *